United States Patent [19]

Holford

[11] Patent Number: 5,074,816

[45] Date of Patent: Dec. 24, 1991

[54] MULTIPURPOSE BOAT BUCKET

[76] Inventor: Philip J. Holford, 1-16 Centerway Road, Orewa, Hibiscus Coast, New Zealand

[21] Appl. No.: 552,062

[22] Filed: Jul. 13, 1990

[51] Int. Cl.[5] ..... B63C 11/00

[52] U.S. Cl. ..... 441/135; 441/136

[58] Field of Search ..... 114/66; 441/135; 43/56; 350/319; 220/82 R, 82 A

[56] References Cited

U.S. PATENT DOCUMENTS

| | | | |
|---|---|---|---|
| 3,628,853 | 12/1971 | Stoscup | 114/66 X |
| 4,145,783 | 3/1979 | Rhodes | 441/135 |
| 4,465,468 | 8/1984 | Deacy | 114/66 X |

FOREIGN PATENT DOCUMENTS

| | | | |
|---|---|---|---|
| 2537436 | 1/1977 | Fed. Rep. of Germany | 441/135 |

*Primary Examiner*—Ed Swinehart

*Attorney, Agent, or Firm*—Whitham & Marhoefer

[57] ABSTRACT

A multiple purpose bucket (10 or 110) can be used as a floatation device, an underwater viewing device, or a bailer. The bucket (10 or 110) includes a body (12 or 112), an open top (14 or 114), a clear plastic bottom (16 or 116), and a base (20 or 120). The base (20 or 120) extends beyond the clear plastic bottom (16 or 116). The base (20 or 120) has a floatation means (21) molded therewithin which gives the bucket (10 or 110) buoyancy. Passages (36, 38, and 122) allow water to quickly fill the cavity created by the base (20 or 120) when the bucket (10 or 110) is being used as an underwater viewing device. Hand grips (28 and 128) are grasped by the user when using the bucket (10 or 110) as a bailer.

13 Claims, 2 Drawing Sheets

FIG. 1
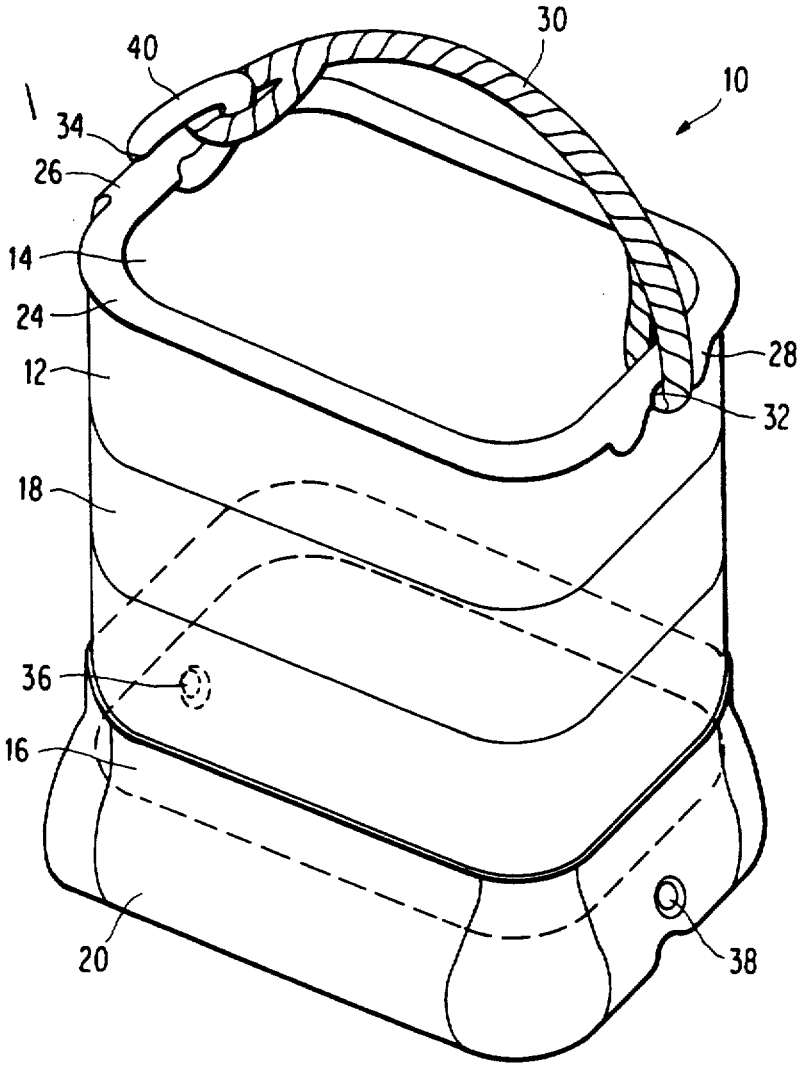
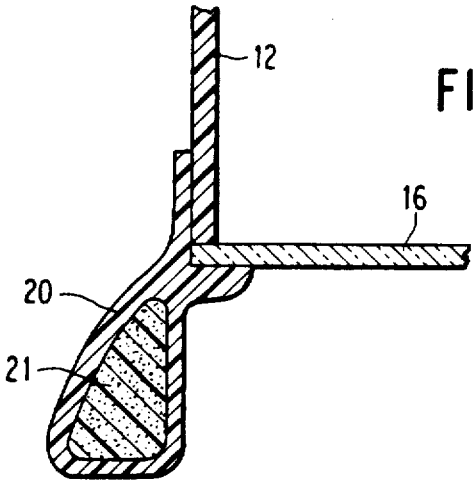
FIG. 1a

MULTIPURPOSE BOAT BUCKET

BACKGROUND OF THE INVENTION

1. Field of the Invention

The present invention generally relates to a bucket used on board a boat and, more particularly, to a bucket which, in addition to fulfilling its normal purpose, can also be used as a bailer, a floatation device, and an underwater viewing device.

2. Description of the Prior Art

A bucket is considered an essential tool on board most boats. Buckets can be used to carry water or bait aboard a boat, to store fish caught on a fishing trip, or for dipping overboard to retrieve water for washing down the deck. Buckets are also treated as a general purpose bailer for bailing out the bottom of the boat in an emergency situation or when the boat owner is out at sea during a rain storm. Too date, most boat owners have given little thought to the type of bucket they bring on board a boat and often will use the type of bucket commonly sold at a grocery store. Most of these buckets, especially the round type bucket, are not designed for bailing out a boat and generally give poor results. An important problem with bringing anything aboard a boat is the space taken by the object. Simply by the space savings alone, it is apparent that a bucket which is designed to have more than one use aboard a boat will be a great improvement over the prior art.

People often want to see what is going on underneath them when they have ventured out into a body of water. A typical example of viewing devices which enhance water visibility are swimmers goggles. When the swimmers head is immersed in the water, the goggle provides an air pocket between the swimmer's eyes and the water and provides the swimmer with a much clearer field of view than without the goggles. U.S. Pat. No. 3,808,621 to French discloses a swimmer's viewing float which provides some support to the swimmer while he or she watches objects below. The float is spherical in shape and contains an air pocket between the top and bottom halves. A swimmer places his or her face in a clear, concave section of the float and views objects through a clear portion of the bottom half of the float. In one embodiment, the French swimmer s float is inflatable. U.S. Pat. No. 4,465,468 to Deacy discloses a rectangular underwater viewing device which, when placed in the water, allows a person to place their head within an open top section and view objects below through the clear sidewalls and bottom. The Deacy underwater viewing device is not designed to be used as a bucket and would tend to sink when water spills over the top rim inside its rectangular body.

SUMMARY OF THE INVENTION

It is therefore an object of the present invention to provide a bucket which has multiple uses aboard a boat.

According to the invention, a bucket has been designed which can fulfill all the ordinary requirements for a bucket and can also be used as bailer, a floatation device, or an underwater viewing device. The bucket is constructed of rugged and durable materials that will not crack, deteriorate, or otherwise be rendered unusable from exposure to salt air, sunshine or general abuse. The bucket has a clear plastic bottom which allows the user to look through the bottom of the bucket when it is held in the ocean, sea, or river, and see whatever the visibility allows. Useful possibilities include enabling the user to retrieve stuck anchors or objects dropped overboard, or enabling the user to view fish and other objects of interest below. When the bucket is not in use as a viewing device, the clear plastic bottom is supported above the boat deck by a base portion such that it will not get scratched up from contact with the deck.

The base portion has a floatation means molded therein which allows the bucket to be used as a floatation device. The floatation means may be a sealed air pocket, buoyant materials such as styrofoam, or any other suitable composition which enables the bucket to support the weight of a person who has fallen overboard. Additional floatation support may be provided by molding buoyant materials within the body of the bucket. The top portion of the bucket has a rigid rim, a scooping lip, and a molded hand grip. The scooping lip and molded hand grip are positioned on opposite sides of the bucket to enable the user to bail water efficiently. In a first embodiment, the bucket is rectangular in shape and is large enough to dip scrub brushes and mops therein. In a second embodiment, the bucket is generally round and more easily used with one hand as a bailer.

BRIEF DESCRIPTION OF THE DRAWINGS

The foregoing and other objects, aspects and advantages will be better understood from the following detailed description of a preferred embodiment of the invention with reference to the drawings, in which:

FIG. 1 is an isometric view of a multipurpose bucket according to the first embodiment of the invention;

FIG. 1*a* is a cut-away cross-sectional view of the base 20 shown in FIG. 1.

DETAILED DESCRIPTION OF A PREFERRED EMBODIMENT OF THE INVENTION

Figure 2:
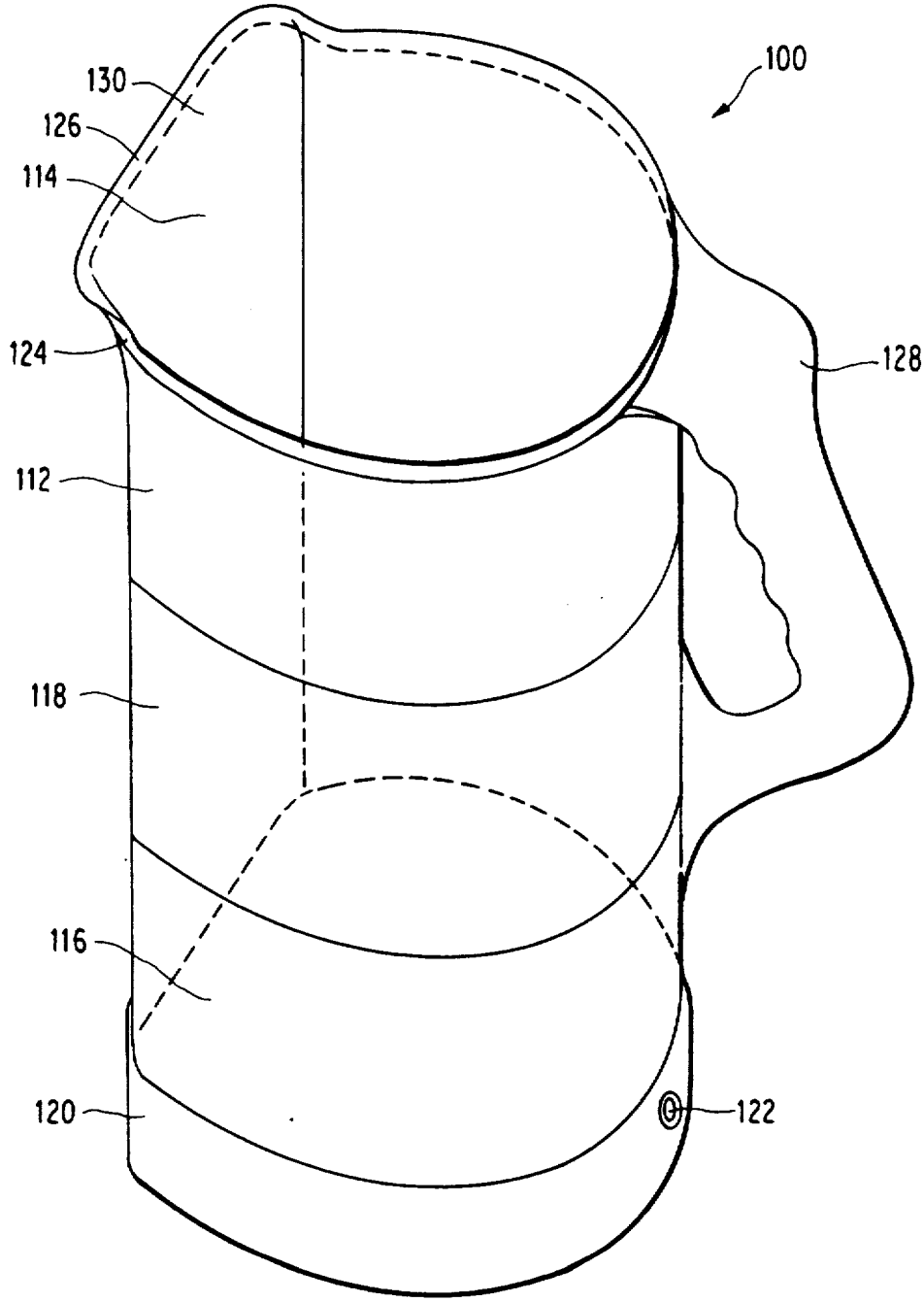
FIG. 2 is an isometric view of a multipurpose bucket according to the second embodiment of the invention.

Referring now to the drawings, and more particularly to FIG. 1, there is shown a bucket 10 having a rectangular body 12, an open top 14, and a closed bottom 16. The bottom 16, which is indicated by a dashed line, is made of a clear plastic material such as plexiglass or any other suitable material. The rectangular body 12 may be integrally molded with the closed bottom 16 or may be made from different materials where the body 12 is attached to the bottom by glue, heat welding, or some other suitable means. The materials chosen for the bucket 10 should be rugged and durable as they must be able to withstand sun, salt water, and general abuse. Buoyant materials such as styrofoam may be molded within the rectangular body 12 to allow the bucket 10 to float if it is dropped overboard.

A luminescent stripe 18 is positioned about the perimeter of the rectangular body 12. The luminescent stripe 18 can be painted thereon, applied as a decal, or provided by some other suitable means. The luminescent stripe 18 aids in the boat owner finding the bucket 10 if it happens to be dropped overboard and will help the Coast Guard find a person floating with the bucket 10 if the person has fallen overboard. The luminescent stripe 18 may include lettering identifying the boat on which it belongs.

A base 20 is connected to the rectangular body 12 and extends beyond the closed bottom 16 of the bucket 10. The base 20 can be integrally molded with the rectangular body 12 or be made of some other material and be attached by a suitable means such as gluing or heat welding. FIG. 1*a* shows the base 20 has a floatation means 21 molded therein. The floatation means 21 may comprise a sealed volume of air, buoyant materials such as styrofoam, or any other suitable composition. The floatation means 21 should be of sufficient buoyancy to support a person (i.e., the average adult as dictated by Coast Guard standards) who has fallen overboard. Preferably, the base 20 is outwardly flared such that the bucket 10 is more stable when resting on the boat deck. The base 20 extends below the clear plastic bottom 16 of the bucket and, thereby, supports the bottom above the boat deck so that it is not scratched up. Hence, the base 20 construction aids in maintaining the bucket's utility as an underwater viewing device.

The top rim 24 of the rectangular body 12 is preferably curled over and gives the rectangular body 12 structural rigidity. The top forward end of the bucket 10 has a scooping lip 26 which, when held flat on the boat deck, aids in bailing out the bottom of the deck. The scooping lip 26 is preferably integrally molded with the bucket 10 on its forward, flat, side. A molded grip 28, formed on the top rearward end of the bucket 10, allows the boat owner to conveniently grasp the bucket 10 when bailing. A detachable rope handle 30 can be secured to the bucket 10 through holes 32 and 34 in the top of the bucket 10 or holes 36 and 38 in the base 20. The ends of the rope handle 30 may include brass clips 40 for securing the rope handle 30 to the holes 32, 34, 36, and 38. The rope handle 30 allows the bucket 10 to be secured to stanchions on the boat.

The above-described bucket has several uses. First of all, the bucket 10 is designed for the regular duties on a boat. Its rectangular shape allows for easy insertion of mops and brushes used to wash off the boat deck. Like any other bucket, the inventive bucket 10 can hold water and therefore can be used to hold bait and fish as well as anything else the boat owner desires. The bucket's 10 rope handle 30 enables the bucket 10 to be secured to the boat in its normal upright or an upside down orientation (when being used as a seat or when you do not want to collect rain water). Secondly, the molded floatation means 21 in the base 20 of the bucket 10 allows it to be used as a safety device. Persons who fall overboard could be readily supported by the bucket 10 until help arrives. Because the floatation means 21 is molded within the base 20, the bucket 10 will not sink when water fills the bucket 10. In addition, the buoyancy of the bucket 10 also helps in its retrieval if it is accidentally dropped overboard and the luminescent stripe 18 helps the boat owner find the bucket 10 floating in the water. Thirdly, the bucket 10 can be used as an underwater viewing device whereby the user simply presses the bottom 16 of the bucket 10 down into the water and then looks therethrough. The holes 36 and 38 through the base 20 of the bucket allow water to freely fill the cavity created by the base 20 and the bottom 16 of the bucket 10, i.e., the holes 36 and 38 enable the bucket 10 to be pushed into the water to a point where the water is in contact with the bottom 16 more easily than if they were not present. If the rectangular body 12 is made from the same material as the closed bottom 16, the user should be able to observe objects through the sides of the bucket 10 as well. Having the base 20 extend beyond the closed bottom 16 is an important feature of this invention since the arrangement protects the clear plastic of closed bottom 16 from being scratched on the deck surface (i.e., scratches would tend to obstruct the user's view). Finally, the bucket 10 can be used as a bailer. In such use, the user simply grabs the handle grip 28 with one hand and the base 20 with his other hand and inserts the bucket 10 into pooled water. The scooping lip 26, at the forward, flat, top section of the bucket 10, enhances the bucket's 10 ability to scoop up water. In addition, having the forward section of the bucket 10 flat relative to the boat deck enlarges the cross-sectional bailing area, thus avoiding the pit falls of round buckets.

FIG. 2 shows a second, smaller design for the multiple purpose boat bucket 110. Here, the bucket 110 includes a generally cylindrical body 112, an open top 114, and a closed bottom 116. As described above, the bottom 116 is made of a clear plastic material which allows users to view objects beneath the boat when the bucket 110 is inserted into the water. The bucket 110 has a base 120 attached to the generally cylindrical body 112 which extends beyond the closed bottom 116. The base 120 has an integrally molded floatation means similar to that shown and discussed in conjunction with FIG. 1*a* which allows the bucket 110 to float in the water when accidentally dropped overboard. Preferably, the base 120 is flared outwardly to give the bucket 110 stability. A hole 122 through the base 120 can be provided to allow water to freely flow into and fill the cavity created by the base 120 and the bottom 116, thereby, making the device more easily useable for underwater viewing purposes. A high visibility stripe 118 positioned on the generally cylindrical body 112 aids the user in retrieving the bucket 110 if it falls overboard. As discussed above, the bucket 110 can be used as a floatation device, a bailer, or an underwater viewing device.

The principle differences between the bucket 110 shown in FIG. 2 and the bucket 10 shown in FIG. 1 are related to the smaller size of bucket 110, i.e., the bucket 110 is preferably six inches in diameter and the bucket 10 has eleven inch and nine inch side walls. A handle 128 is provided on the rear part of the bucket 110 and allows the user to easily bail with one hand. To aid in bailing, the front section 130 of the bucket 110 is relatively flat, thereby increasing the cross-sectional bailing area. A top rim 124 gives the bucket 110 rigidity and an scooping lip 126 allows water to be more easily scooped into the bucket 110.

While the invention has been described in terms of its preferred embodiments where a rectangular or generally cylindrical bucket includes a clear plastic bottom and a base which has a floatation means therein, those skilled in the art will recognize that the invention can be practiced with modification within the spirit and scope of the appended claims.

Having thus described my invention, what I claim as new and desire to secure by letters patent is as follows:

1. A multipurpose bucket, comprising:

a body having a sidewall, an open top and a closed bottom, said sidewall defining a volume above said closed bottom for holding a fluid where said open top provides access to said volume, said closed bottom including a clear member;

a base connected to said body at a position opposite said open top and extending below said closed bottom, said base having a portion adjacent a periphery of said bottom, said base having an inside wall and an outside wall, said inside wall of said base and said bottom of said body defining a cavity beneath said bottom of said body;

a floatation means positioned within said base; and a passage extending through said inside wall of said base to a point on said outside wall to permit fluids to be transported through said base to and from said cavity, said passage being positioned in said base at a point below said bottom of said body.

2. A multipurpose bucket as recited in claim 1 wherein said floatation means is a sealed air pocket.

3. A multipurpose bucket as recited in claim 1 wherein said floatation means is a buoyant material.

4. A multipurpose bucket as recited in claim 3 wherein said buoyant material is styrofoam.

5. A multipurpose bucket as recited in claim 1 wherein said body and said base are integrally molded.

6. A multipurpose bucket as recited in claim 1 wherein said base is flared outwardly from said periphery of said bottom of said body as said base extends below said bottom of said body.

7. A multipurpose bucket as recited in claim 1 wherein said sidewall is comprised of four flat members arranged in the form of a rectangle, a first flat member having a scooping lip on a top surface and a second flat member opposite said first flat member having a handle.

8. A multipurpose bucket as recited in claim 1 wherein said sidewall is comprised of a flat member and a partially circular member, a top surface of said flat member having a scooping lip, said partially circular member having a handle positioned thereon.

9. A multipurpose bucket as recited in claim 1 further comprising a luminescent material positioned on said body.

10. A multipurpose bucket, comprising:

a body comprised of a solely single walled sidewall formed into four flat sections and arranged as a rectangular structure, a first flat section having a scooping lip on a top surface and a second flat section opposite said first flat section having a handle;

a clear bottom member connected to said solely single walled sidewall so as to provide said body with a closed bottom, said sidewall defining a volume above said closed bottom for holding a fluid where an open top of said body opposite said closed bottom provides access to said volume;

a base connected to aid body and extending below said closed bottom, said base having a portion adjacent a periphery of said clear bottom member, said base having an inside wall and an outside wall, said inside wall and said clear bottom member defining a cavity beneath said closed bottom; and a solid buoyant material positioned within said base.

11. A multipurpose bucket as recited in claim 10 wherein said solid buoyant material is styrofoam.

12. A multipurpose bucket, comprising:

a body comprised of a solely single walled sidewall formed into a flat section and a partially circular section and arranged as a partial cylindrical structure, said flat section having a scooping lip on a top surface and said partially circular section having a handle;

a clear bottom member connected to said solely single walled sidewall so as to provide said body with a closed bottom, said sidewall defining a volume above said closed bottom for holding a fluid where an open top of said body opposite said closed bottom provides access to said volume;

a base connected to said body and extending below said closed bottom, said base having a portion adjacent a periphery of said clear bottom member, said base having an inside wall and an outside wall, said inside wall and said clear bottom member defining a cavity beneath said closed bottom; and a solid buoyant material positioned within said base.

13. A multipurpose bucket as recited in claim 12 wherein said solid buoyant material is styrofoam.

* * * * *